US008690141B2

(12) United States Patent
Sugiyama

(10) Patent No.: US 8,690,141 B2
(45) Date of Patent: Apr. 8, 2014

(54) SHEET FOLDING DEVICE, IMAGE FORMING APPARATUS USING THIS DEVICE, AND SHEET FOLDING METHOD

(75) Inventor: Hideaki Sugiyama, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 498 days.

(21) Appl. No.: 13/027,202

(22) Filed: Feb. 14, 2011

(65) Prior Publication Data

US 2011/0218090 A1 Sep. 8, 2011

Related U.S. Application Data

(60) Provisional application No. 61/311,259, filed on Mar. 5, 2010.

(51) Int. Cl.
*B31F 1/10* (2006.01)
*B31B 1/56* (2006.01)

(52) U.S. Cl.
USPC ..... 270/32; 270/58.07; 493/444; 493/445; 493/435

(58) Field of Classification Search
USPC ..... 270/32, 37, 58.07; 493/424, 434, 435, 493/437, 438, 439, 442, 443, 444, 445, 454
See application file for complete search history.

(56) References Cited

U.S. PATENT DOCUMENTS

| | | | | |
|---|---|---|---|---|
| 7,300,045 | B2 | 11/2007 | Terao et al. | |
| 7,458,567 | B2 * | 12/2008 | Yamada et al. | 270/58.07 |
| 7,648,136 | B2 | 1/2010 | Terao et al. | |
| 7,802,778 | B2 | 9/2010 | Kurita | |
| 8,292,283 | B2 * | 10/2012 | Matsuno et al. | 270/39.01 |
| 8,317,179 | B2 * | 11/2012 | Takata | 270/37 |
| 2010/0320673 | A1 * | 12/2010 | Takata | 270/37 |
| 2011/0316215 | A1 * | 12/2011 | Matsuno et al. | 270/37 |

* cited by examiner

*Primary Examiner* — Leslie A Nicholson, III
(74) *Attorney, Agent, or Firm* — Patterson & Sheridan LLP

(57) ABSTRACT

According to an embodiment of the invention, a sheet folding device includes a pair of folding rollers which nips a sheet between the folding rollers and thus folds the sheet, a folding blade which pushes the sheet in between the pair of folding rollers, and a folding blade control unit which controls the folding blade to fold a first sheet with the pair of folding rollers, then push a second sheet into the fold of the first sheet, and fold the second sheet with the pair of folding rollers over the first sheet.

20 Claims, 11 Drawing Sheets

SHEET FOLDING DEVICE, IMAGE FORMING APPARATUS USING THIS DEVICE, AND SHEET FOLDING METHOD

CROSS-REFERENCE TO RELATED APPLICATION

This application is based upon and claims the benefit of priority from Provisional U.S. Application 61/311259 filed on Mar. 5, 2010, the entire contents of which are incorporated herein by reference.

FIELD

Embodiments described herein relate generally to a sheet folding device which performs folding of printed sheets or the like, an image forming apparatus using this device, and a sheet folding method.

BACKGROUND

Conventionally, a sheet finisher is known which is installed downstream of an image forming apparatus such as a copier, printer or multi-functional peripheral (MFP) and performs finishing such as punching or stitching of printed sheets.

The functions of the sheet finisher are increasingly diversified. A sheet finisher (middle-folding device) is proposed which has a folding function to fold a part of the sheet and a function of saddle-stitching and middle-folding to staple a central part of the sheet and then fold the sheet at the central part, in addition to the functions of punching and stitching.

In the case of such middle-folding, it is preferable to form a satisfactory fold in order to reduce the thickness of the folded booklet. To this end, it is preferable to nip and fold sheets one by one between a pair of rollers. However, folding sheets one by one in this manner takes time and efficient folding cannot be performed. Meanwhile, when plural sheets are superimposed and folded at a time, efficient folding can be performed. However, it is difficult to form a satisfactory fold on each of the plural sheets.

In view of the foregoing problems of the conventional technique, the invention is to provide a folding device capable of forming a satisfactory fold on each sheet and performing efficiency folding, an image forming apparatus using this device, and a folding method for the same.

DESCRIPTION OF THE DRAWINGS

FIG. 10 is a sectional view showing the positional relation between the folding rollers and the folding blade when the folding blade is away in the embodiment.

FIG. 11 is a sectional view showing the positional relation between the folding rollers and the folding blade when the folding blade comes close in the embodiment.

FIG. 12 is a sectional view showing the state where the first sheet is placed on the stack tray in the embodiment.

FIG. 13 is a sectional view showing the state where the first sheet placed on the stack tray is being folded in the embodiment.

FIG. 14 is a sectional view showing the state where the first sheet is folded and the second sheet is placed on the stack tray in the embodiment.

FIG. 15 is a sectional view showing the state where the first sheet is folded and the second sheet, too, is subsequently being folded in the embodiment.

FIG. 16 is a sectional view showing the state where three sheets are continuously folded in the embodiment.

DETAILED DESCRIPTION

According to an embodiment of the invention, a sheet folding device includes a pair of folding rollers which nips a sheet between the folding rollers and thus folds the sheet, a folding blade which pushes the sheet in between the pair of folding rollers, and a folding blade control unit which controls the folding blade to fold a first sheet with the pair of folding rollers, then push a second sheet into the fold of the first sheet, and fold the second sheet with the pair of folding rollers over the first sheet.

Hereinafter, an embodiment of an image forming apparatus and a sheet folding device according to the invention will be described with reference to the drawings.

Figure 1:
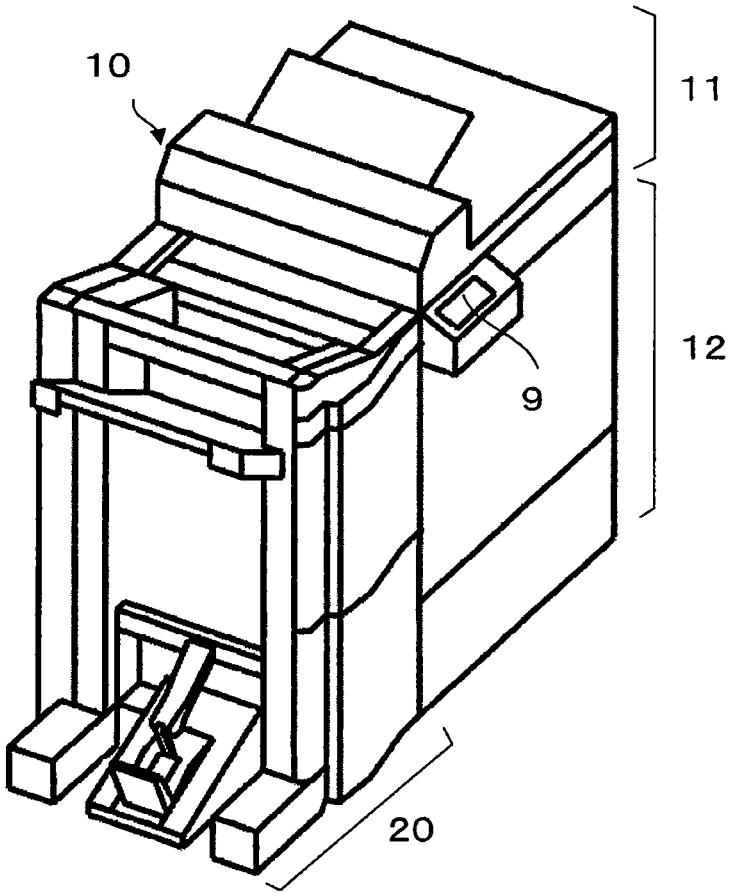
FIG. 1 is a perspective view showing the appearance of an image forming apparatus and a sheet finisher according an embodiment.

FIG. 1 is an outer perspective view showing a basic configuration of an image forming apparatus 10 according to this embodiment. The image forming apparatus 10 has a reading unit 11 which reads a document, an image forming unit 12 which prints the read image data of the document to a sheet, for example, by an electrographic technique, a sheet finisher 20 which performs finishing such as sorting, punching, folding and saddle-stitching, and the like. The image forming unit 12 has an operation unit 9 for a user to carry out various operations.

Figure 2:
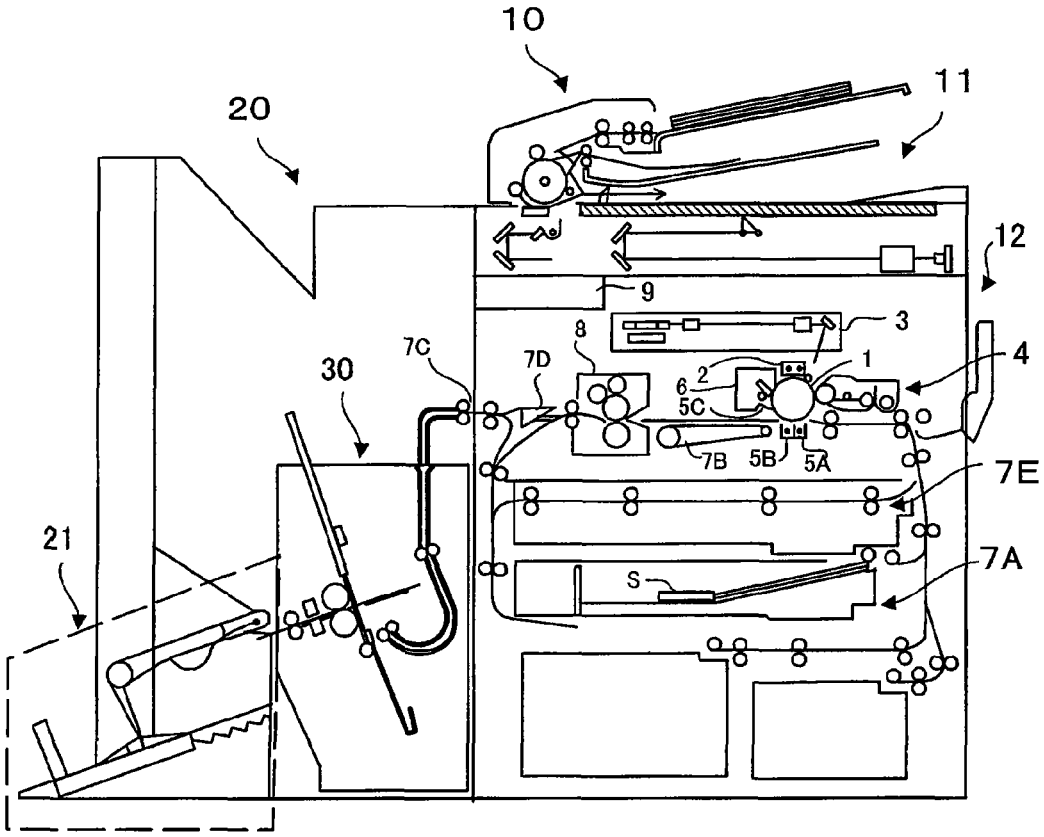
FIG. 2 is a sectional view showing an exemplary configuration of the image forming apparatus and the sheet finisher according to the embodiment.

FIG. 2 shows a sectional view of a detailed exemplary configuration of the image forming apparatus 10. The image forming unit 12 of the image forming apparatus 10 has a photoconductive drum 1 at its center. A charger unit 2, an exposure unit 3, a developing unit 4, a transfer unit 5A, a neutralizing unit 5B, a separation pawl 5C, and a cleaning unit 6 are arranged around the photoconductive drum 1. A fixing unit 8 is provided downstream of the neutralizing unit 5B. By these units, image formation is carried out roughly according to the following procedures.

First, the charger unit 2 uniformly charges the surface of the photoconductive drum 1. Meanwhile, the document read by the reading unit 11 is converted to image data and inputted to the exposure unit 3. The exposure unit 3 casts a laser beam corresponding to the level of the image data to the photoconductive drum 1 and thus forms an electrostatic latent image on the photoconductive drum 1. The electrostatic latent image is developed with a toner supplied from the developing unit 4. A toner image is thus formed on the photoconductive drum 1.

A sheet housed in a sheet housing unit 7A is carried to the space between the photoconductive drum 1 and the transfer unit 5A, which is the transfer position, via several carrying rollers. At the transfer position, the toner image is transferred from the photoconductive drum 1 to the sheet by the transfer unit 5A.

The neutralizing unit 5B erases the electric charges on the surface of the sheet to which the toner image is transferred. The separation pawl 5C separates the sheet from the photoconductive drum 1. After that, the sheet is carried by an intermediate carrying unit 7B. The toner image is then fixed to the sheet by heating and pressurizing by the fixing unit 8. The sheet on which the fixing is finished is discharged from a discharge unit 7C and outputted to the sheet finisher 20.

The cleaning unit 6 arranged downstream of the separation pawl 5C removes the residual developer on the surface of the photoconductive drum 1 and thus the apparatus becomes ready for the next image formation.

In the case of double-side print, the sheet having the toner image fixed to its surface is diverted from the ordinary discharge path by a carrying path switch board 7D and the sides of the sheet are reversed in a switchback-like manner in a reverse carrying path 7E. For the reversed sheet, print similar to single-side print is carried out on the back side and the sheet is outputted from the discharge unit 7C to the sheet finisher 20.

The sheet finisher 20 has a sheet folding device 30 and a sheet placing unit 21, in addition to a sorter unit which sorts the sheet. The sheet folding device 30 folds plural printed sheets discharged from the image forming unit 12, as will be described below. The sheets folded by the sheet folding device 30 are outputted to and placed in the sheet placing unit 21.

Figure 3:
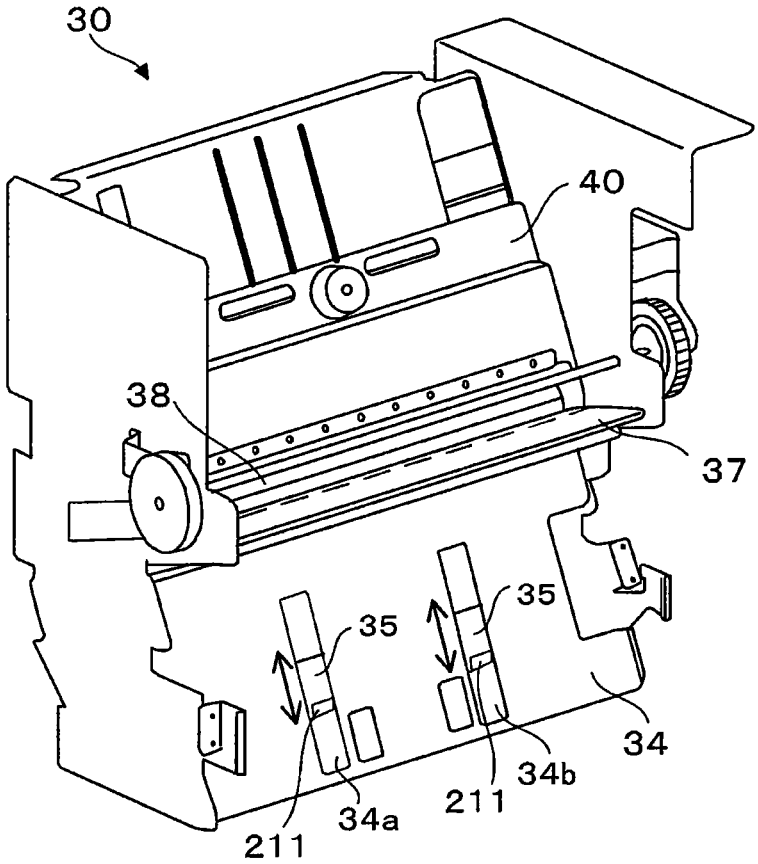
FIG. 3 is a perspective view showing an example configuration of a sheet folding device according to an embodiment.

FIG. 3 shows a perspective view of the sheet folding device 30, as viewed from upstream in the sheet carrying direction. In FIG. 3, a mechanism to carry and supply a sheet to the stack tray is not shown.

The sloped stack tray is seen below the sheet folding device 30. A folding roller pair 38 is provided at the back of a central part of the sheet folding device 30. A folding blade 37 is provided in front of the folding roller pair 38. Stack pawls 211 of stackers 35 are for controlling the position of a sheet, which will be described later, and are controlled to move along apertures 34*a* and 34*b* of a stack tray 34 in the direction indicated by double-pointed arrows. The stack tray 34 is provided with a lateral alignment mechanism 40 which laterally aligns a sheet, and a tray sheet detection unit 45 which detects whether there is a sheet on the stack tray 34. The tray sheet detection unit 45 includes, for example, a light receiving unit 45*a* and a light source 45*b* provided on the face and backside of the stack tray 34 (see FIG. 5). A hole is opened in the stack tray 34. When there is no sheet on the stack tray 34, light emitted from the light source 45*b* enters the light receiving unit 45*a* and the absence of sheet is detected.

Figure 4:
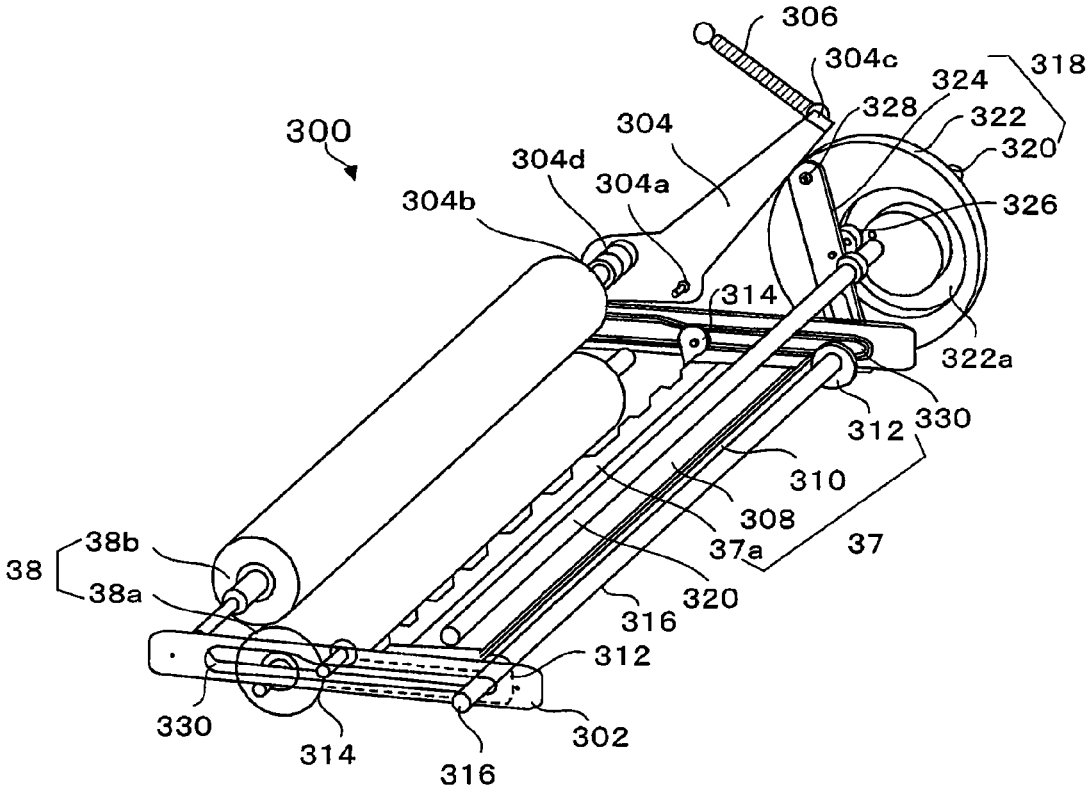
FIG. 4 is an enlarged perspective view showing a part of the sheet folding device according to the embodiment.

The folding of a sheet is carried out mainly by a middle folding unit 300 including the folding roller pair 38 made up of two folding rollers that contact each other and the folding blade 37 which inserts the sheet to be nipped between the folding roller pair 38 in appropriate timing. FIG. 4 shows a perspective view showing the structure of the middle-folding unit 300.

The middle-folding unit 300 has the folding roller pair 38 which folds a sheet bundle into two, the folding blade 37 as a pushing member which pushes the sheet bundle into the nip part of the folding roller pair 38, and a guide member 302 which holds the folding blade 37 in a manner that the folding blade 37 is movable toward the folding roller pair 38, and which regulates fluctuation in a direction intersecting the direction of movement of the pushing member before the sheet bundle is pushed into the nip part.

The folding roller pair 38 includes a folding roller 38*a* and a folding roller 38*b*. The folding roller 38*a* is rotatably supported on a device frame. Meanwhile, the folding roller 38*b* is rotatably supported on one end 304*b* of an arm 304 and can move in a direction orthogonal to the direction of movement of the folding blade 37. The folding roller 38*b* can move toward and away from the folding roller 38*a*.

A spring 306 is attached to the other end 304*c* of the arm 304. The folding roller 38*b* rotates via the arm 304 rotated about a fulcrum 304*a* by the spring 306. In this case, a first supporting hole 304*d* is provided which enables the folding roller 38*b* to move linearly instead of arcuately.

The folding blade 37 has a blade forward end 37*a* which strikes the sheet bundle, first and second holding members 308 and 310 which hold the blade forward end 37*a* between the first and second holding members, and lateral plates 312 attached at both sides of the second holding member 310.

A stud 314 is provided on a forward part of the lateral plate 312, that is, on the side of the folding roller pair 38. A shaft 316 is attached to a rear part. The folding blade 37 is held in a slidable manner on the guide member 302 via the stud 314 and the shaft 316.

The longer the length of the shaft 316 of the stud 314 is, the more stability is obtained. Therefore, in this embodiment, the position of attachment of the stud 314 is closer to the side of the folding roller pair 38 than the blade forward end 37*a*. The stud 314 and the shaft 316 as sliding members are not limited to the above configuration. Both these two members may be studs or shafts. Alternatively, rotatable rolling members may also be used. The position of attachment of the stud 314 to the lateral plate 312 is not limited to the above configuration, either.

A driving unit 318 to slide the folding blade 37 is provided at both ends of the shaft 316. The driving unit 318 has a cam shaft 320 and a groove part 322*a*, and also has a groove cam 322 rotatable about the cam shaft 320, and a driven member 324. In the groove part 322*a* of the groove cam 322, a rolling member 326 such as a roller follower, for example, as a contractor, is guided rotatably. The rolling member 326 is attached to the driven member 324. A driven member rotary shaft 328 is provided at one end of the driven member 324. The driven member rotary shaft 328 is attached to the device frame. The groove cam 322 is rotated by a driving motor connected to one end of the cam shaft 320.

As the groove cam 322 rotates and the rolling member 326 is guided along the groove part 322*a*, the driven member 324 repeats reciprocating like a pendulum about the driven member rotary shaft 328 according to the eccentricity of the groove part 322*a*.

Figure 5:
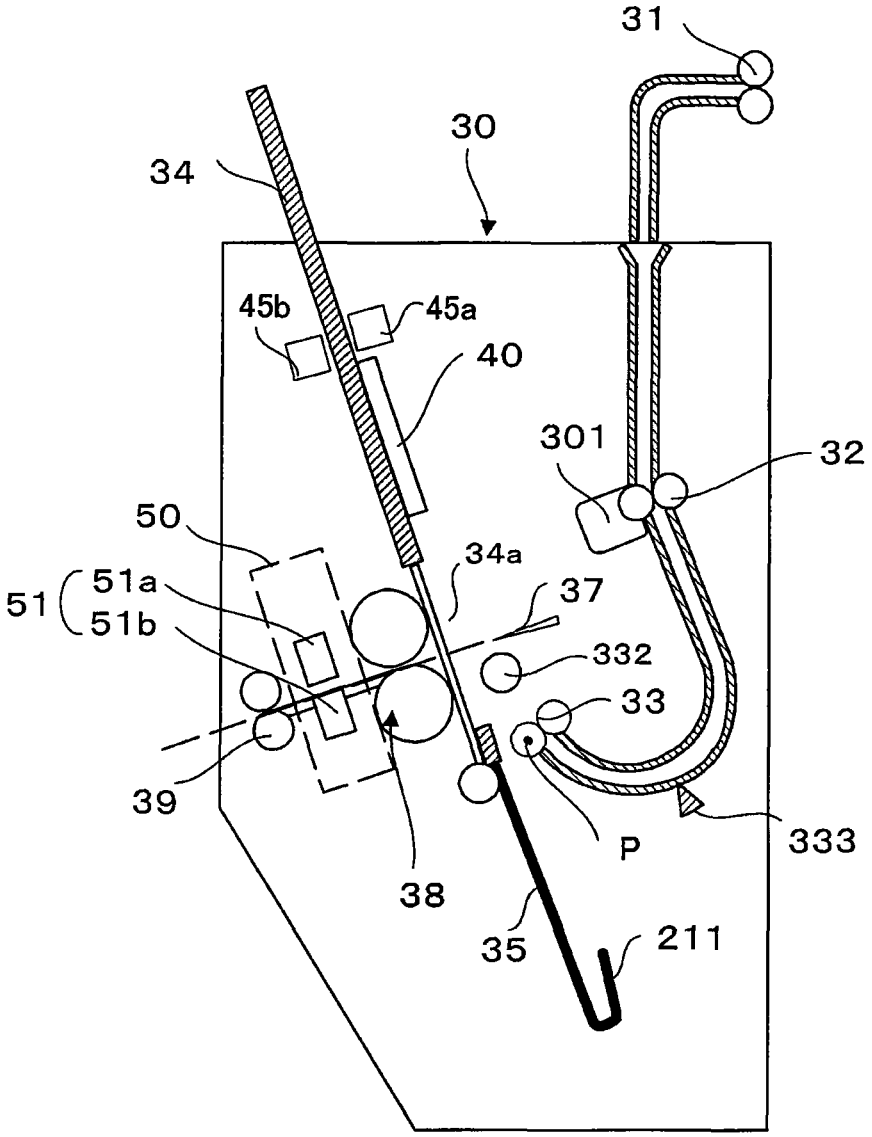
FIG. 5 is a sectional view showing the structure of the sheet folding device according to the embodiment.
Figure 6:
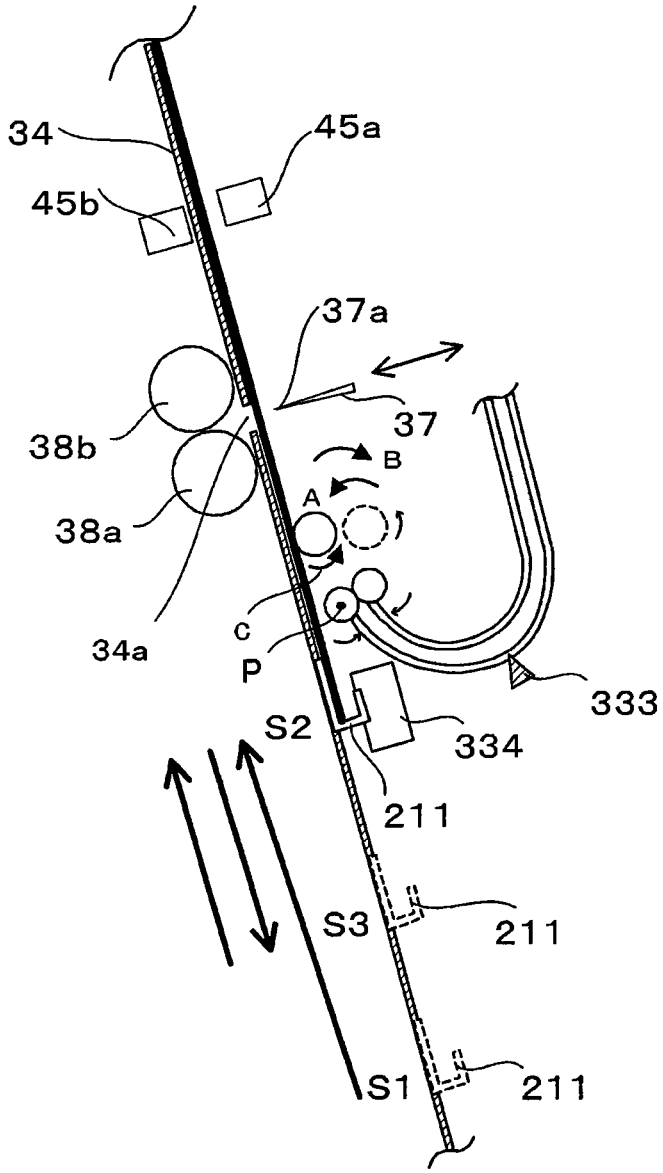
FIG. 6 is a sectional view of essential parts for explaining an operation to supply a sheet to a stack tray in the sheet folding device according to the embodiment.

FIG. 5 is a sectional view showing a detailed configuration of the sheet folding device 30 shown in FIG. 2. FIG. 6 is an enlarged sectional view showing a part of the sheet folding device 30. In the sheet folding device 30, a sheet discharged from the discharge unit 7C of the image forming unit 12 is received by an entrance roller pair 31, then carried and delivered to an intermediate roller pair 32. The intermediate roller pair 32 carries and delivers the sheet to an exit roller pair 33. The exit roller pair 33 sends out the sheet to the stack tray 34 having a sloped placing surface. The forward end of the sheet moves toward the top of the slope of the stack tray 34. The sheet, folded and exiting the folding roller pair 38, passes a fold reinforcing unit 50 that is provided downstream, then passes a carrying roller 39, and is then stacked in the sheet placing unit 21. The stack tray 34 has the aperture 34*a*.

The fold reinforcing unit 50 has a fold reinforcing roller pair 51 including an upper roller 51 and a lower roller 51*b*. The fold reinforcing roller pair 51 moves while pressurizing a fold in a direction (direction along the fold) orthogonal to the sheet carrying direction, and thus reinforces the fold.

As shown in FIG. 5, an assist roller 332 is provided ahead of the exit roller pair 33. As shown in FIG. 5, the sheet folding device 30 has a carrying motor 301. The carrying motor 301 synchronously drives the exit roller pair 33 and the assist roller 332 via a timing belt, not shown.

As shown in FIG. 6, when sending out a sheet to the stack tray 34, the assist roller 332 is located at the position indicated by the broken line so as not to disturb the sheet from being sent out. The assist roller 332 is movable in the directions indicated by arrows A and B.

A sheet detection sensor 333 is provided in the carrying path for the sheet and detects passage of the forward edge and the rear edge of the sheet passing through the carrying path. When sending out the sheet to the stack tray 34, the assist roller 332 moves in the direction of arrow B. As the sheet detection sensor 333 detects the rear end of the sheet, after a predetermined time from this point, it is determined that the sheet is completely sent out to the stack tray 34. Then, the position of the assist roller 332 is moved in the direction of arrow A about a fulcrum P. This movement causes the assist roller 332 to contact the sheet sent out to the stack tray 34.

Since the assist roller 332 is rotated in the direction of arrow C by the carrying motor 301, the sheet sent out to the stack tray 34 is moved downward. The surface of the assist roller 332 is covered with a sponge or the like. Therefore, the assist roller 332 can move the sheet downward without damaging the sheet.

In a lower part of the stack tray 34, the stack pawl 211 is provided movably in an up-down direction. The stack pawl 211 usually stands by at a standby position S1. When the sheet is to be sent out to the stack tray 34 as described above, the stack pawl 211 moves up to a sheet receiving position S2. Then, at the sheet receiving position S2, the stack pawl 211 receives the lower end of the sheet pushed down by the assist roller 332 from the top of the slope of the stack tray 34. After that, the stack pawl 211 moves down to a folding position S3. Hereinafter, the description that the sheet is placed on the stack tray may refer to the sheet arriving at the folding position.

Figure 7:
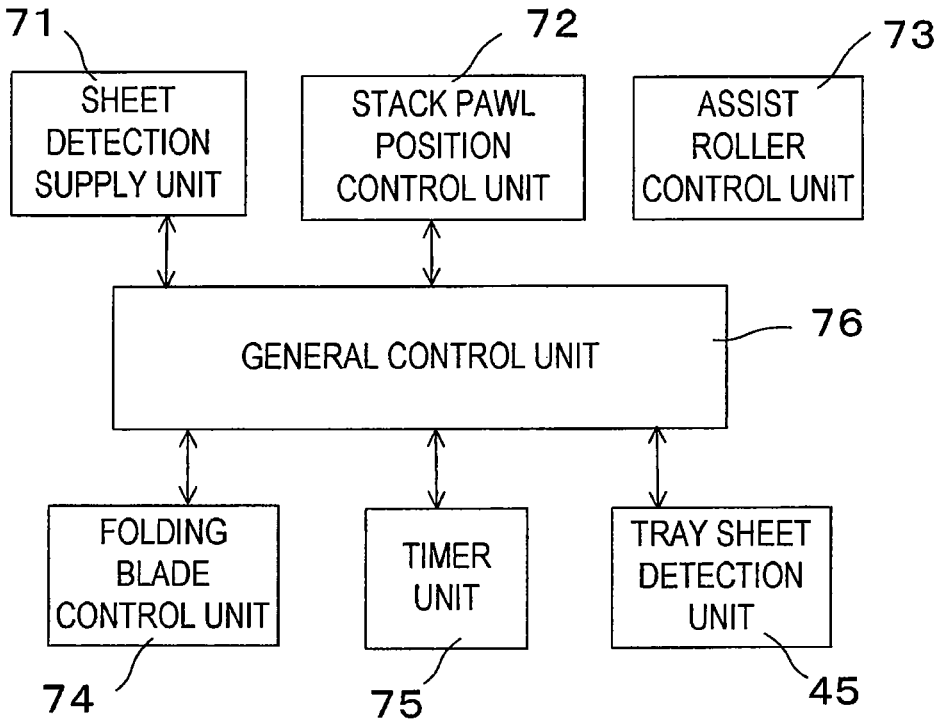
FIG. 7 shows an exemplary configuration of overall control of the sheet folding device according to the embodiment.

FIG. 7 shows an exemplary configuration of the control system of the sheet folding device. The sheet folding device has a sheet detection supply unit 71 which detects a sheet using the sheet detection sensor 333, a stack pawl position control unit 72 which moves up and down the stack pawl 211 on the stack tray 34 to the positions S1, S2 and S3, an assist roller control unit 73 which controls the movement of the assist roller 332 between the positions A and B and the direction of rotation of this roller, a folding blade control unit 74 which controls the movement of the folding blade, a timer unit 75 which measures time following the start of folding, the tray sheet detection unit 45 which detects the presence or absence of a sheet on the stack tray 34, and a general control unit 76 which controls each of these units.

Figure 8A:
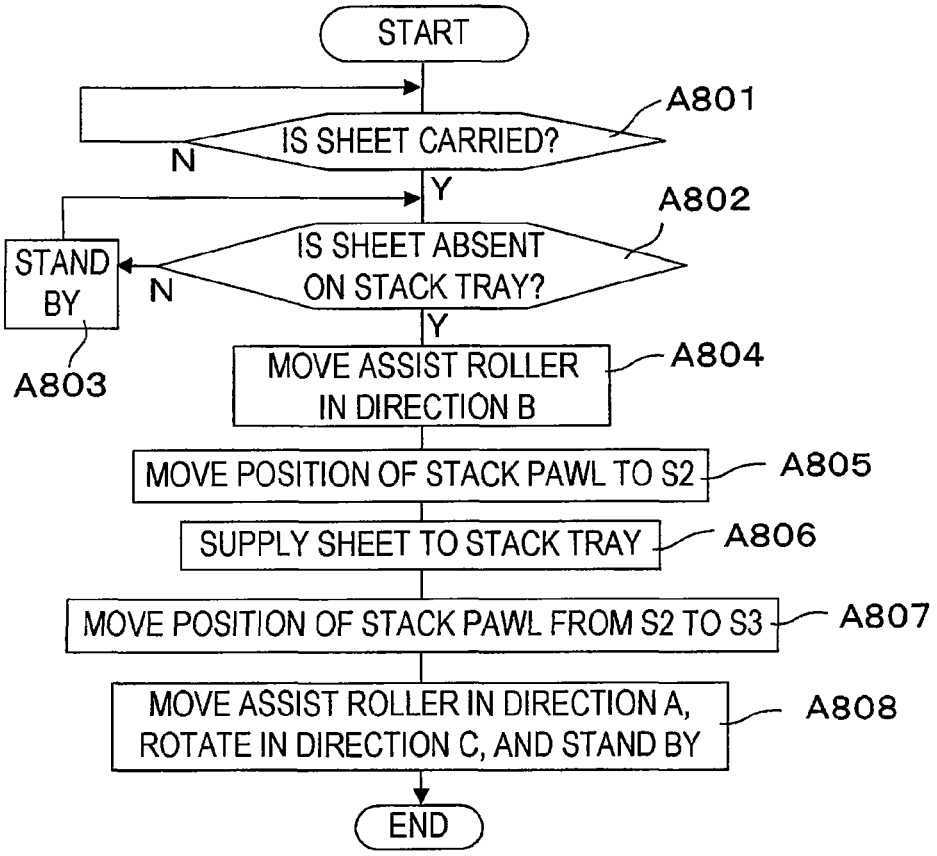
FIG. 8A is a view for explaining the operation in a sheet supply mode in the embodiment.
Figure 8B:
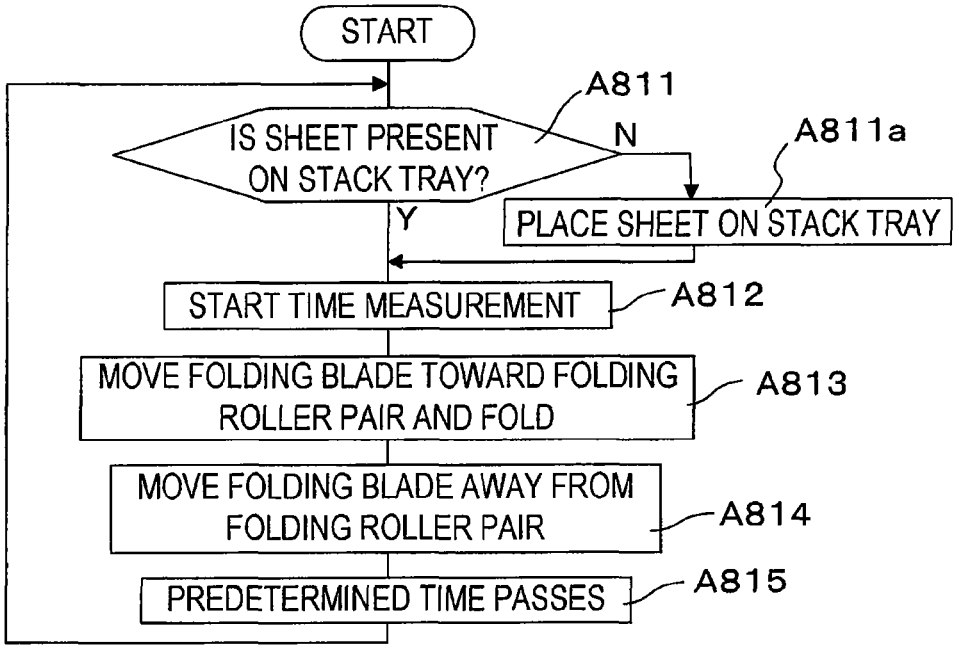
FIG. 8B is a view for explaining the operation in a folding mode in the embodiment.

Next, the operation of the sheet folding device 30 will be described with reference to the flowcharts shown in FIG. 8A and FIG. 8B. FIG. 8A is a flowchart of a sheet supply mode to supply a sheet to the folding position on the stack tray 34. FIG. 8B shows a flowchart of a folding mode to fold the sheet placed at the folding position on the stack tray 34.

In ACT A801 in FIG. 8A, the sheet detection sensor 333 constituting the sheet detection supply unit 71 detects that the first sheet to be folded is carried thereto. When the sheet is detected, the tray sheet detection unit 45 detects in ACT A802 whether the sheet is already absent on the stack tray 34 or not. When the sheet is on the stack tray 34 (N in ACT A802), the carried sheet is held in that state in ACT A803.

Meanwhile, in ACT A802, when the sheet is absent on the stack tray, the processing shifts to ACT A804. The assist roller 332 is moved in the direction B (see FIG. 6) under the control of the assist roller control unit 73 so that the sheet can easily be carried onto the stack tray 34. In the next ACT A805, the stack pawl 211 is moved from the standby position S1 to the sheet receiving position S2 under the control of the stack pawl position control unit 72.

In the next ACT A806, the sheet is supplied to the stack tray 34 under the control of the sheet detection supply unit 71. As the sheet is placed on the stack tray 34, in ACT A807, the position of the stack pawl 211 is moved to the folding position S3 under the control of the stack pawl position control unit 72.

Then, in the next ACT A808, the assist roller 332 is moved in the direction A (see FIG. 6). That is, the assist roller 332 contacts the sheet on the stack tray 34. In this state, the assist roller 332 is rotated in the direction C under the control of the assist roller control unit 73. Thus, the sheet on the stack tray moves down to the position where the sheet is folded, and then stands by in this state.

Figure 9:
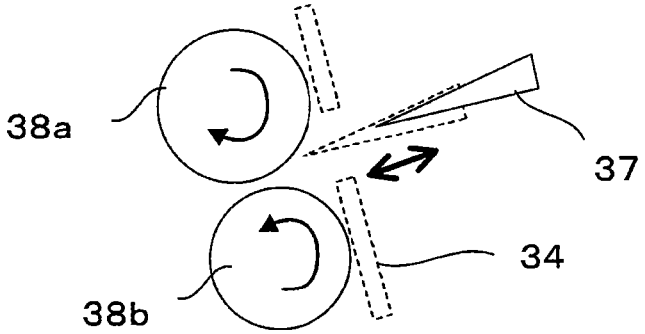
FIG. 9 is a sectional view showing the positional relation between a folding roller pair and a folding blade in the embodiment.
Figure 1:
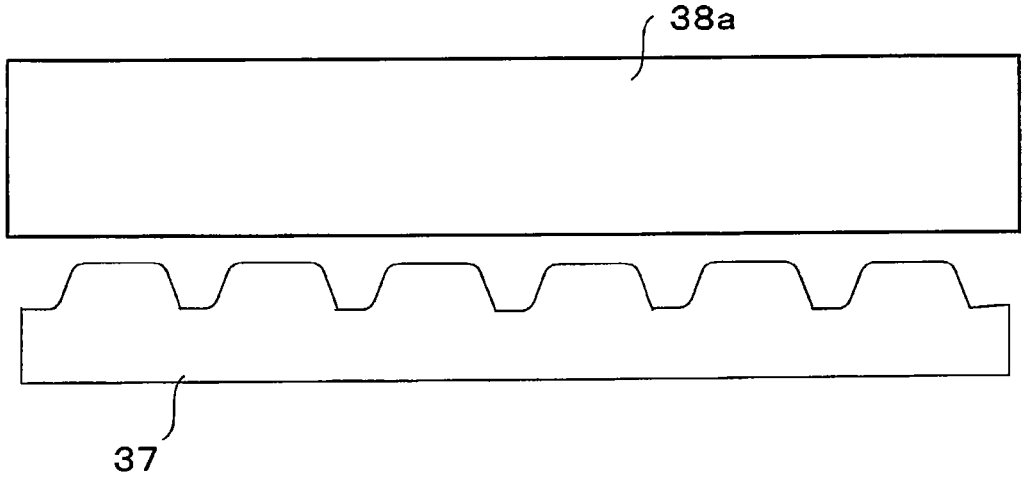
Figure 1:
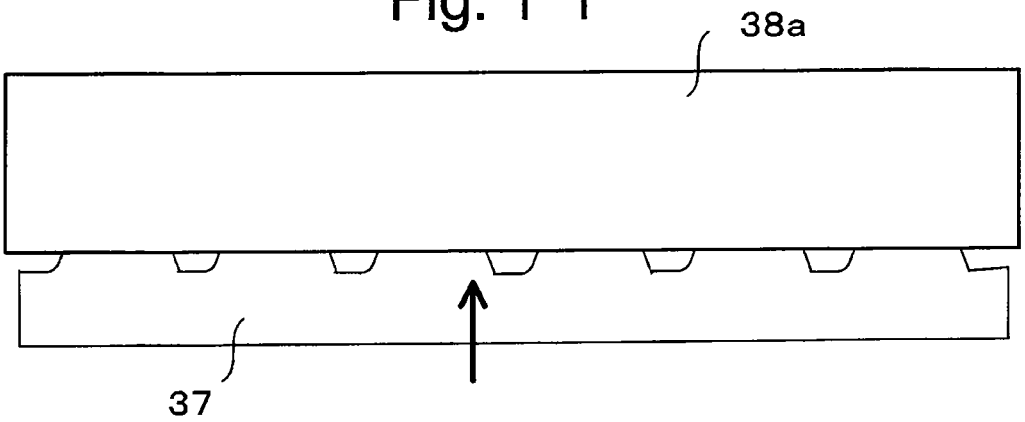
Figure 1:
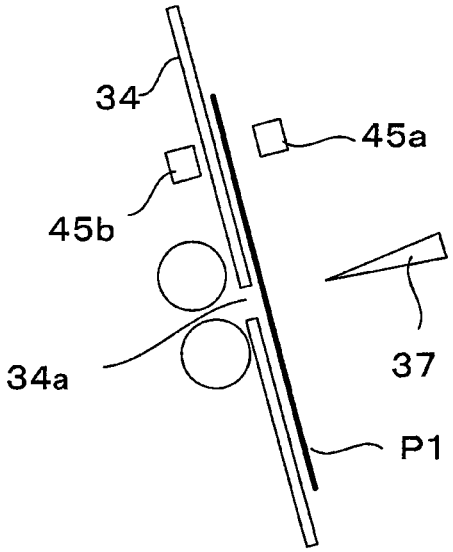
Figure 1:
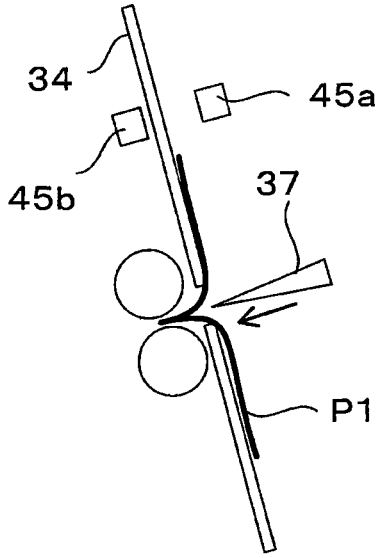
Figure 1:
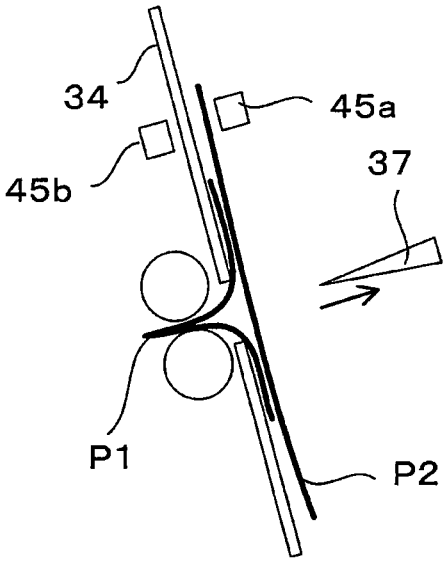
Figure 1:
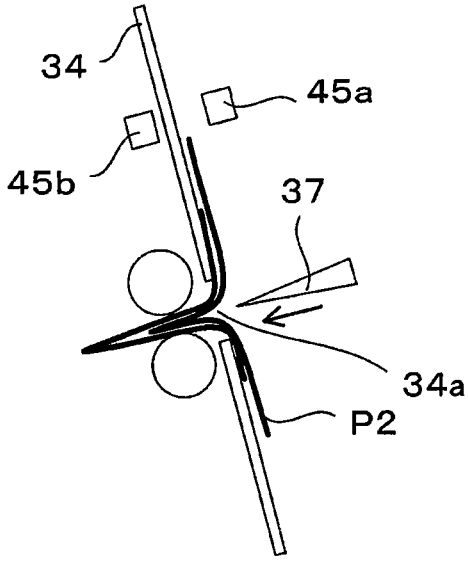
Figure 1:
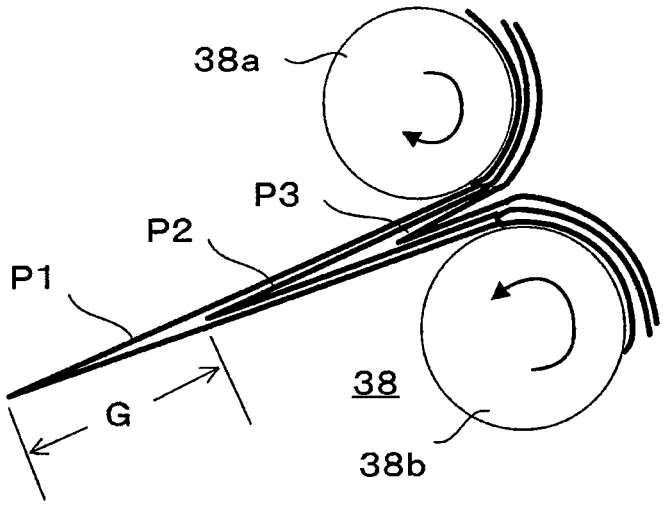

FIG. 9 is a sectional view showing the positional relation between the folding rollers 38*a* and 38*b* forming the folding roller pair 38 and the folding blade 37. FIG. 10 and FIG. 11 are plan views showing the relation between the folding rollers and the folding blade in the case where the folding blade 37 is in the standby state and in the case where the folding blade 37 is in the processing state.

The folding blade 37 is rectangular and has a wedged cross section with a pointed distal end on the side of the folding roller pair 38, as shown in FIG. 9. The end of the folding blade 37 on the side of the folding roller pair 38 has a concave-convex shape, as shown in FIG. 10. The purpose of this shape is to enable smooth folding of the sheet and to protect the sheet.

FIG. 12 to FIG. 15 show various states in continuous processing of folding where the folding blade 37 is moved to left and right.

When the folding blade 37 is in the standby state indicated by the solid lines in FIG. 9, the folding blade 37 is away from the folding roller 38*a* as shown in FIG. 10 and FIG. 12. Meanwhile, in the processing state where the folding blade 37 performs folding, as indicated by the dotted lines in FIG. 9, the folding blade 37 approaches the boundary of the folding rollers 38*a* and 38*b*, as shown in FIG. 11. The folding rollers 38*a* and 38*b* constantly rotate in the direction shown in the drawings. FIG. 13 shows the state where the first one sheet is folded.

In the folding mode shown in FIG. 8B, first, in ACT A811, the light source 45*b* and the light receiving unit 45*a* constituting the tray sheet detection unit 45 detect whether the first sheet is placed on the stack tray 34 and at the folding position. FIG. 12 shows the state where the first sheet P1 is placed on the stack tray 34. It is desirable that the light source 45*b* and the light receiving unit 45*a* are provided at such positions that the sheet is detected in the state where the sheet is placed on the stack tray 34, as shown in FIG. 12, and such that the sheet is no longer detected as the folding progresses, as shown in FIG. 13.

When the sheet is detected in ACT A811 (Y in A811), the processing shifts to ACT A812 and the timer unit 75 measures time following the start of the folding.

When the sheet is not placed in ACT A811, the sheet is placed on the stack tray 34 in ACT A811*a* and then time measurement is started in ACT A812. It is also possible to place the sheet on the stack tray 34 first in ACT A811 and then move the sheet to the folding position S3.

In ACT A813, the folding blade 37 is moved closer to the part between the folding rollers 38*a* and 38*b*, as shown in FIG. 13. The first sheet P1 is pushed in between the folding rollers 38*a* and 38*b* from the aperture 34*a* of the stack tray 34 and is thus folded.

In the next ACT A814, the folding blade 37 is moved away from the folding rollers 38*a* and 38*b* as shown in FIG. 14, and the second sheet P2 is placed on the stack tray (see FIG. 14).

In ACT A815, a lapse of a predetermined time after the timer unit 75 starts measuring time in ACT A812 is detected. Then, the processing returns to ACT A811. As the tray sheet detection unit 45 detects in ACT A811 that the second sheet P2 is placed on the stack tray 34, again, the timer unit 75 starts measuring time in ACT A812. In the next ACT A813, the second sheet P2 is folded as shown in FIG. 15.

In this case, the second sheet is folded by the folding rollers 38*a* and 38*b* from above the first sheet P1. Similarly, as long as a sheet is detected on the stack tray 34 in ACT A811, the timer unit 75 starts measuring time in ACT A812 and the folding blade 37 is moved toward the folding roller pair 38 to perform folding under the control of the folding blade control unit 74. In ACT A814, the folding blade 37 is moved away from the folding roller pair 38. In the next ACT A815, the predetermined time is confirmed.

In this manner, the folding of the first sheet P1 is finished and the second sheet P2 is folded. Sheets are similarly folded continuously. FIG. 16 shows a sectional view of three sheets P1, P2 and P3 that are continuously folded. In FIG. 16, the stack tray 34 is not shown. By changing the time period from the time point of starting the folding of the preceding sheet to the time point of starting the folding of the subsequent sheet as measured by the timer unit 75, it is possible to change the spacing G from the folding forward end of the preceding sheet to the folding forward end of the subsequent sheet in FIG. 16. The smaller the folding forward end spacing G is, the folding becomes more efficient. However, if the spacing G is too small, the folding of each of sheets is not performed sufficiently. Therefore, it is desirable that the spacing is large enough to allow for sufficient folding of the forward end by the folding roller pair, but is as small as possible.

According to this embodiment, as folding is continuously performed, the processing time for folding per sheet can be reduced and the efficiency of the processing can be improved.

In the embodiment, the example is described in which it is detected that a sheet is placed on the stack tray, based on the interruption of light using the light source and the light receiving unit provided to face each other on the backside and face of the stack tray. The optical detection of a sheet on the stack tray may also be carried out by a light source and a light receiving unit provided in a lateral direction on the stack tray. According to the invention, it is also possible to detect a sheet by a mechanical device such as a switch, as well as such optical detection.

In the embodiment, the continuous folding of sheets is carried out in a way that according to the time from the time point of starting the preceding folding, the subsequent folding is carried out. However, instead of time, for example, it is possible to adjust the position of the tray sheet detection unit provided on the stack tray and thus carry out the folding in appropriate timing.

That is, since the sheet is supplied to the folding rollers via the aperture 34*a* during the folding in progress, as shown in FIG. 13 and FIG. 15, the sheet part situated on the stack tray becomes smaller. Thus, when the sheet is no longer detected by the tray sheet detection unit, this means that the folding of the preceding sheet is substantially progressed. Therefore, if the folding of the subsequent sheet is started at this point, the folding of the subsequent sheet can be carried out where the folding of the preceding sheet is progressed to a certain extent.

In the embodiment, the case where the invention is applied to a multi-functional color copier is described. However, the invention can be used as a sheet folding device of a finisher used not only in a multi-functional color copier but also in other image forming apparatuses which has an image forming unit to generate an image to be printed on a sheet and which designates sheet types for print, such as an ordinary copier, printer, or facsimile.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and sprit of the inventions.

What is claimed is:

1. A sheet folding device comprising:

a pair of folding rollers which nips a sheet between the folding rollers and thus folds the sheet;

a folding blade which pushes the sheet in between the pair of folding rollers; and a folding blade control unit configured to control the folding blade to push a first sheet and cause the first sheet to be folded using the pair of folding rollers, and then push a second sheet into the fold of the first sheet positioned between the pair of folding rollers and cause the second sheet to be folded using the pair of folding rollers while the second sheet is disposed within the fold of the first sheet.

2. The device according to claim 1, wherein the folding blade has a rectangular shape provided parallel to the axis of rotation of the pair of folding rollers and is movable in a direction orthogonal to a longitudinal direction of the rectangular shape.

3. The device according to claim 2, wherein the folding blade has a wedged cross section that is thinner on a side close to the pair of folding rollers.

4. The device according to claim 3, wherein the folding blade has a notched shape on a side close to the pair of folding rollers.

5. A sheet folding device comprising:

a pair of folding rollers which nips a sheet between the folding rollers from a side where the folding rollers rotate inward toward each other, and thus folds the sheet;

a stack tray on which the sheet to be folded by the pair of folding rollers is placed a folding blade which pushes the sheet placed on the stack tray in between the pair of folding rollers; and a folding blade control unit configured to control the folding blade to push a first sheet and cause the first sheet to be folded using the pair of folding rollers, and then push a second sheet into the fold of the first sheet positioned between the pair of folding rollers and cause the second sheet to be folded using the pair of folding rollers while the second sheet is disposed within the fold of the first sheet.

6. The device according to claim 5, further comprising a timer unit, wherein the folding blade control unit causes the folding of the second sheet after a predetermined time from the start of the folding of the first sheet as measured by the timer unit, and thus causes the folding of the second sheet while the second sheet is disposed within the fold of the first sheet.

7. The device according to claim 6, wherein the folding blade has a rectangular shape provided parallel to the axis of rotation of the pair of folding rollers and is movable in a direction orthogonal to a longitudinal direction of the rectangular shape.

8. The device according to claim 7, wherein the folding blade has a wedged cross section that is thinner on a side close to the pair of folding rollers.

9. The device according to claim 8, wherein the folding blade has a notched shape on a side close to the pair of folding rollers.

10. The device according to claim 9, further comprising a tray sheet detection unit which detects whether the sheet is placed on the stack tray or not.

11. The device according to claim 5, further comprising a tray sheet detection unit which detects whether the sheet is placed on the stack tray or not.

12. The device according to claim 11, wherein from when the first sheet placed on the stack tray is no longer detected by the tray sheet detection unit, the second sheet is placed on the stack tray and the second sheet is pushed into the fold of the first sheet.

13. The device according to claim 12, wherein the folding blade has a rectangular shape provided parallel to the axis of rotation of the pair of folding rollers and is movable in a direction orthogonal to a longitudinal direction of the rectangular shape.

14. The device according to claim 13, wherein the folding blade has a wedged cross section that is thinner on a side close to the pair of folding rollers.

15. The device according to claim 14, wherein the folding blade has a notched shape on a side close to the pair of folding rollers.

16. An image forming apparatus using a folding device, the apparatus comprising:

an image forming unit which forms an image to be printed on a sheet;

a printing unit which prints the image formed by the image forming unit;

a pair of folding rollers which nips a sheet printed by the printing unit between the pair of folding rollers and thus folds the sheet;

a stack tray on which the sheet to be folded by the pair of folding rollers is placed;

a folding blade which pushes the sheet placed on the stack tray in between the pair of folding rollers; and a folding blade control unit configured to control the folding blade to push a first sheet and cause the first sheet to be folded using the pair of folding rollers, and then push a second sheet into the fold of the first sheet positioned between the pair of folding rollers and cause the second sheet to be folded using the pair of folding rollers while the second sheet is disposed within the fold of the first sheet.

17. The apparatus according to claim 16, further comprising a timer unit, wherein the folding blade control unit causes the folding of the second sheet after a predetermined time from the start of the folding of the first sheet as measured by the timer unit, and thus causes the folding of the second sheet while the second sheet is disposed within the fold of the first sheet.

18. The apparatus according to claim 17, wherein the folding blade has a rectangular shape provided parallel to the axis of rotation of the pair of folding rollers and is movable in a direction orthogonal to a longitudinal direction of the rectangular shape.

19. A sheet folding method comprising:

from a side where a pair of folding rollers rotates inward toward each other, pushing a first sheet in between the pair of folding rollers with a folding blade to cause a fold of the first sheet to be formed; and then pushing a second sheet into the fold of the first sheet positioned between the pair of folding rollers with the folding blade, after a predetermined time has passed from start of the first sheet pushing, so that the second sheet is folded by the pair of folding rollers while the second sheet is disposed within the fold of the first sheet.

20. The method according to claim 19, wherein the folding blade has a rectangular shape provided parallel to the axis of rotation of the pair of folding rollers and is movable in a direction orthogonal to a longitudinal direction of the rectangular shape.

* * * * *